United States Patent [19]

Hogue

[11] 4,413,489

[45] Nov. 8, 1983

[54] FURNITURE LOCK

[75] Inventor: Norman E. Hogue, Niles, Mich.

[73] Assignee: Packard Industries, Inc., Niles, Mich.

[21] Appl. No.: 303,211

[22] Filed: Sep. 18, 1981

[51] Int. Cl.[3] ..... E05B 65/08; E05B 65/44; E05C 1/02

[52] U.S. Cl. ..... 70/81; 70/95; 70/100; 70/DIG. 20; 70/DIG. 27; 292/179; 292/DIG. 46; 312/297

[58] Field of Search ..... 312/297; 70/81, DIG. 20, 70/DIG. 27, 100, 95, 96–99; 292/179, 150, DIG. 47, DIG. 46, DIG. 36; 160/231

[56] References Cited

U.S. PATENT DOCUMENTS

| | | | |
|---|---|---|---|
| 729,549 | 6/1903 | Collins | 70/81 |
| 3,258,062 | 6/1966 | Lambert | 292/DIG. 36 |
| 3,401,995 | 9/1968 | Diack | 70/95 X |
| 3,460,878 | 8/1969 | Peterson et al. | 312/297 |
| 3,600,912 | 8/1971 | Foreman | 70/95 X |
| 3,863,470 | 2/1975 | Imer | 70/100 |
| 4,009,599 | 3/1977 | Patriquin | 70/DIG. 20 |
| 4,036,541 | 7/1977 | Kantor | 292/DIG. 46 |
| 4,345,448 | 8/1982 | Solomon | 70/95 |

FOREIGN PATENT DOCUMENTS

| | | | |
|---|---|---|---|
| 97284 | 6/1924 | Austria | 70/95 |
| 1285814 | 8/1972 | United Kingdom | 312/297 |

*Primary Examiner*—Gary L. Smith
*Assistant Examiner*—Carl F. Pietruszka
*Attorney, Agent, or Firm*—James D. Hall

[57] ABSTRACT

A lock for furniture or similar articles with a flexible tamboured cover which traverses a track. Upon actuation of the lock, the pin is shifted within the track and prevents movement of the cover therein.

3 Claims, 6 Drawing Figures

Fig. 3
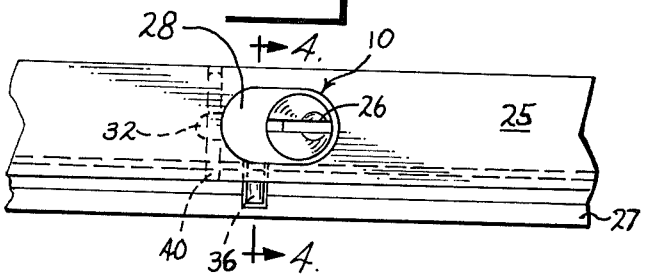
Fig. 4
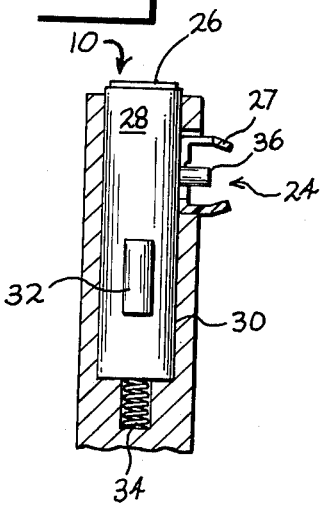
Fig. 5
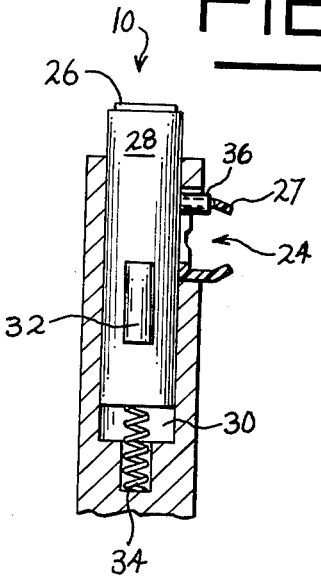
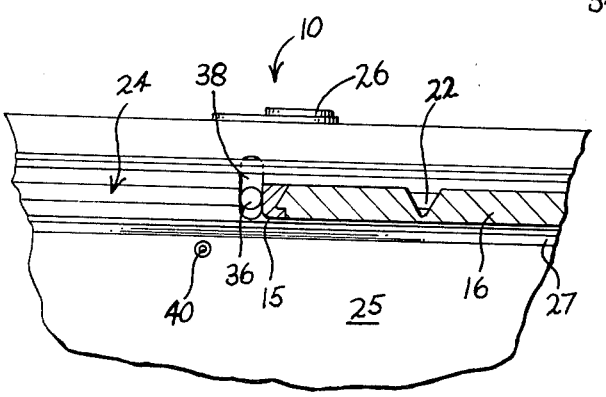
Fig. 6

FURNITURE LOCK

SUMMARY OF THE INVENTION

This invention relates to a lock for furniture and will have special application to furniture with a flexible tamboured or roll top cover shiftable within a track.

Presently, to lock a piece of furniture which utilizes a tamboured cover requires an interaction of a latch between the cover and the furniture body. This requires the abutment of the cover and furniture body. Also, this type of lock does not allow securement in other than a closed position.

The subject invention allows for the flexibility of use of a tamboured cover. Depending upon the position of the lock, the cover can be held at any point of closure. The lock utilizes a pin which is urged into a groove or track. The pin may function as either a block or frictional stop, depending upon the position of the cover. In the unlocked position, the pin is located outside the track. When it is desired to lock the cover, an actuator is depressed and the pin moved into the track groove. The pin creates a frictional stop by wedging between adjacent sections of the tambour slots.

Accordingly, it is an object of this invention to provide a lock for an article with a tamboured or roll top cover.

Another object is to provide a device for positioning of a flexible tamboured cover between a full open and closed position.

Another object is to provide a simple and novel way of locking a flexible tamboured cover.

Other objects will become apparent upon a reading of the following description.

BRIEF DESCRIPTION OF THE DRAWINGS

A preferred embodiment has been chosen to best describe the principles of this invention wherein:

FIG. 3 is a fragmentary top view showing the lock actuator as seen along line 3—3 of FIG. 2.

FIG. 4 is a detailed sectional view of the lock in its locked position as taken along line 4—4 of FIG. 3.

FIG. 5 is a detailed sectional view of the lock in its unlocked position taken along line 4—4 of FIG. 3.

FIG. 6 is a fragmentary side view showing the lock in its locked position.

DESCRIPTION OF THE PREFERRED EMBODIMENT

Figure 1:
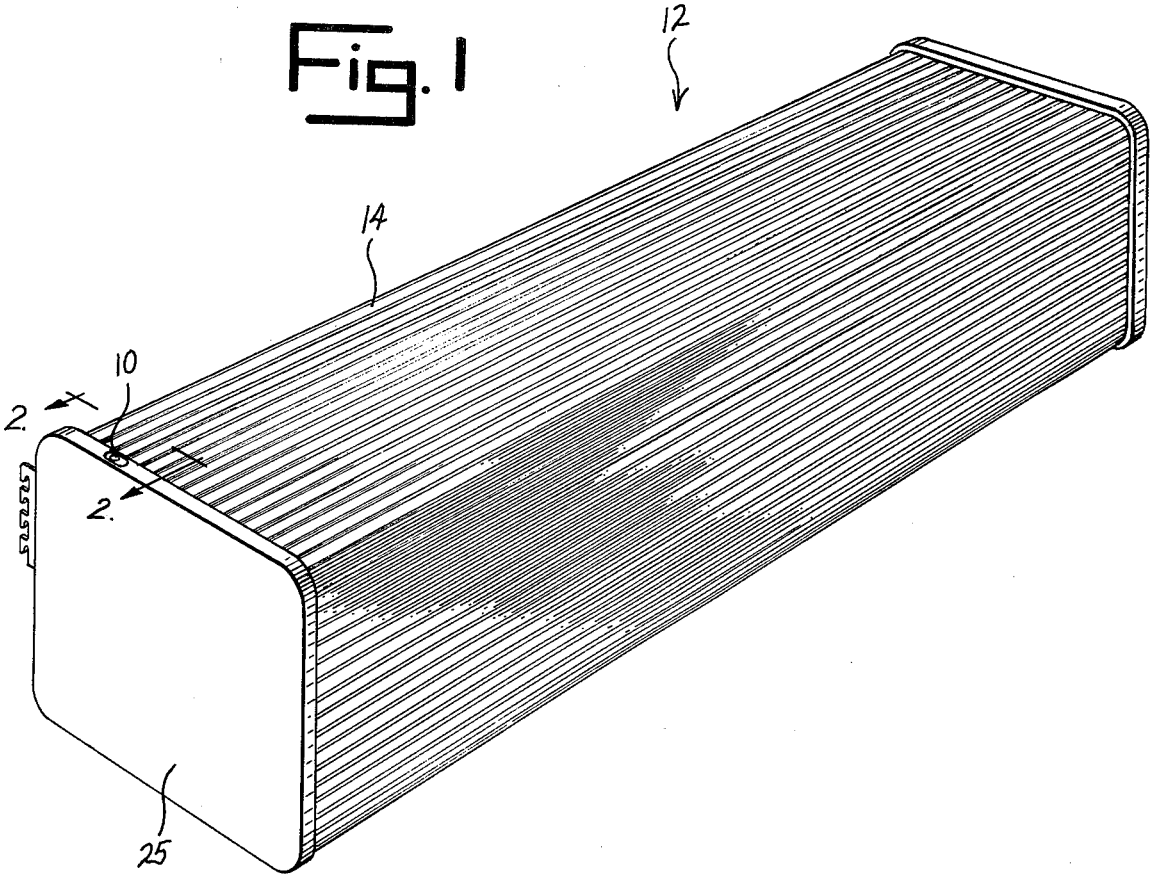
FIG. 1 is a perspective view of an article with a tamboured cover utilizing this invention.
Figure 2:
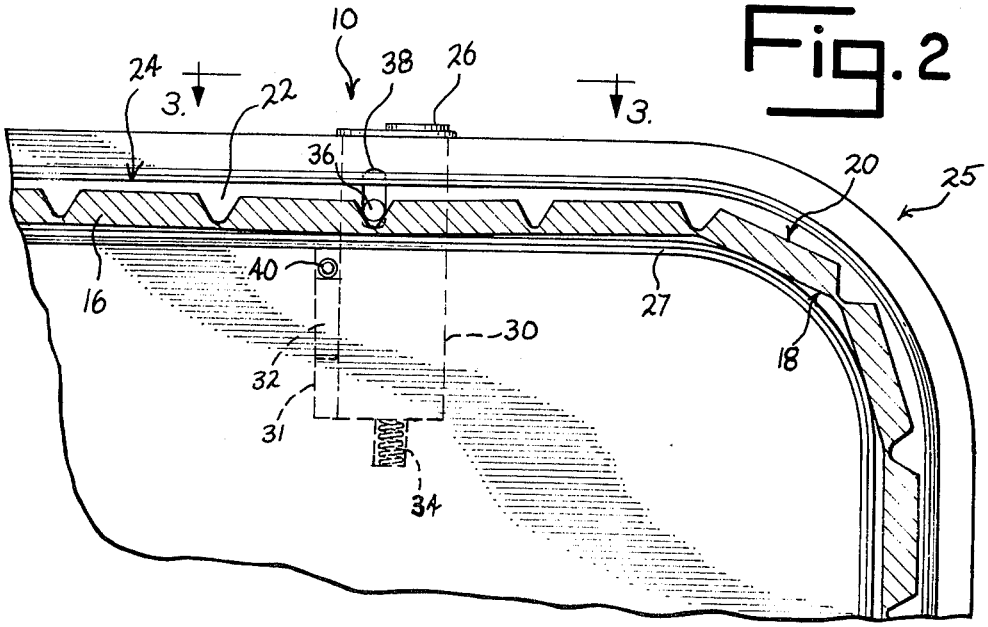
FIG. 2 is a fragmentary cross sectional view showing the invention taken along line 2—2 of FIG. 1.

The preferred embodiment illustrated is not intended to be exhaustive or to limit the invention to the precise form disclosed. It is chosen and described in order to best explain the principles of the invention and its application and practical use to thereby enable others skilled in the art to best utilize the invention.

As shown in the drawings, lock 10 is used in an article 12. Article 12 is fitted with a flexible cover 14. The flexibility of cover 14 is allowed by hinged tambour slats 16. Slats 16 are continuous on one side 18. The other side 20 of slats 16 is bevelled to form openings 22 therebetween. Cover 14 is fitted at each end into a track 24 formed within spaced end walls 25 of article 12. Article 12 can be a storage or similar cabinet. Track 24 includes a guide channel part 27.

Lock 10 includes a keyed actuator 26 which forms a part of a lock cylinder 28. Cylinder 28 is inserted into a bore 30 formed in one end wall 25 of article 12. Cylinder 28 has a spring biased, retractable latch 32. A pin 36 extends transversely from cylinder 28 of lock 10. Pin 36 extends through a transverse slot 38 in wall 25 and intersects track 24 in the wall. Pin 36 is shiftable longitudinally within slot 38 and track 24 upon movement of cylinder 28 as seen in FIGS. 4 and 5. A spring 34 is fitted into bore 30 between cylinder 28 and wall 25 to urge the cylinder from its retracted or locking position shown in FIG. 4 into its extended or open position shown in FIG. 5. A pin 40 extends through wall 25 in front of latch 32.

To lock, cylinder 28 is pushed into bore 30 compressing spring 34 until latch 32 springs into an enlarged portion 31 of bore 30 behind pin 40. Pin 36 carried by cylinder 28 is now located within track 24. To open, a key is inserted into actuator 26 and turned to withdraw latch 32 from bore portion 31 and allow spring 34 to move the cylinder to its open position and to shift pin 36 from track 24. This allows free movement of cover 14 within the track. Pin 36 prevents cylinder 28 from being removed entirely from end wall bore 30.

To lock cover 14 in a predetermined position, cylinder 28 is shifted into its locked position so that pin 36 fits within a selected opening 22 between slats 16 of cover 14. As shown in FIG. 6, pin 36 can also be positioned to prevent the leading edge 15 of cover 14 from passing along track 24.

It is to be understood that the invention is not to be limited to the preceding description, but may be modified within the scope of the appended claims.

What I claim is:

1. A lock for an article with a tamboured cover shiftable within spaced tracks formed in end walls of the article, said lock comprising a cylinder and a pin, said cylinder including a latch and fitted within one end wall of said article and being shiftable within said one end wall between a locked position wherein said latch is extended to engage said one end wall and an open position wherein said latch is retracted, said one end wall having a slot therein intersecting the track in the one end wall, said cylinder carrying said pin, said pin extending into said slot and being shiftable into said one end wall track when said cylinder is in its locked position to contact said cover.

2. The lock of claim 1 wherein said cover includes flexible sections having opposite end edges fitted into said spaced tracks, openings between said flexible sections at one of said end edges thereof, said pin fitting within a selected one of said section openings when said cylinder is in its locked position.

3. The lock of claim 1 and spring means for normally urging said cylinder into its open position.

* * * * *